US007391405B2

(12) United States Patent
Ahn

(10) Patent No.: US 7,391,405 B2
(45) Date of Patent: Jun. 24, 2008

(54) METHOD AND APPARATUS FOR DRIVING LIQUID CRYSTAL DISPLAY

(75) Inventor: Seung Kuk Ahn, Kumi-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 85 days.

(21) Appl. No.: 10/022,854

(22) Filed: Dec. 20, 2001

(65) Prior Publication Data

US 2002/0089484 A1 Jul. 11, 2002

(30) Foreign Application Priority Data

Dec. 20, 2000 (KR) ..... 2000-0079375

(51) Int. Cl.
*G09G 3/36* (2006.01)

(52) U.S. Cl. ..... 345/99; 345/98; 345/100; 345/204; 345/213

(58) Field of Classification Search ..... 345/87–103, 345/204, 698, 699, 208–213; 348/790, 792; 713/500

See application file for complete search history.

(56) References Cited

U.S. PATENT DOCUMENTS

| | | | | |
|---|---|---|---|---|
| 4,855,724 | A * | 8/1989 | Yang | 345/88 |
| 5,301,031 | A * | 4/1994 | Eto et al. | 348/792 |
| 5,406,308 | A * | 4/1995 | Shiki | 345/99 |
| 5,999,158 | A * | 12/1999 | Sekido et al. | 345/98 |
| 6,049,320 | A * | 4/2000 | Yeo | 345/99 |
| 6,067,067 | A | 5/2000 | Park | |
| 6,084,562 | A * | 7/2000 | Onda | 345/94 |
| 6,236,388 | B1 * | 5/2001 | Iida et al. | 345/698 |
| 6,329,975 | B1 * | 12/2001 | Yamaguchi | 345/99 |
| 6,348,931 | B1 * | 2/2002 | Suga et al. | 345/699 |
| 6,417,847 | B1 * | 7/2002 | Mametsuka | 345/213 |
| 6,512,506 | B1 * | 1/2003 | Shimada | 345/99 |
| 6,559,839 | B1 * | 5/2003 | Ueno et al. | 345/213 |
| 6,683,596 | B2 * | 1/2004 | Ozawa | 345/100 |
| 6,718,478 | B2 * | 4/2004 | Yoon et al. | 713/500 |
| 6,791,518 | B2 * | 9/2004 | Furukoshi | 345/87 |
| 2001/0013849 | A1 | 8/2001 | Furukoshi | |

FOREIGN PATENT DOCUMENTS

| | | |
|---|---|---|
| JP | 08-160922 | 6/1996 |
| JP | 09-258669 | 10/1997 |
| JP | 10-301544 | 11/1998 |
| JP | 11-003070 | 1/1999 |
| JP | 09-281931 | 10/2001 |

* cited by examiner

*Primary Examiner*—Kent Chang
(74) *Attorney, Agent, or Firm*—Morgan Lewis & Bockius LLP

(57) ABSTRACT

A method and apparatus for driving a liquid crystal display wherein a picture quality can be clearly kept upon conversion of a resolution mode of the liquid crystal display. In the method and apparatus, a reset signal is generated at an enable initiation time of a data enable signal, and a source shift clock for sampling video data is reset in response to the reset signal.

6 Claims, 10 Drawing Sheets

FIG.2
CONVENTIONAL ART

| Video Mode | N | PinName |
|---|---|---|
| WHEN THE NUMBER OF DCLK AT DE BLANKING INTERVAL IS EVEN NUMBER(n) | 1 | Dclk [XGA 65MHz] (Falling Egde of Latch) |
| | 2 | Video Data |
| | 3 | Data Lactch |
| | 4 | Toggle at Dclk Rising |
| | 5 | Odd Data La1ch |
| | 6 | FOUR TIMES Toggle SIGNAL INVERSION |
| | 7 | Even Data Latch |
| | 8 | FOUR TIMES Toggle SIGNAL INVERSION |
| | 9 | Even Data Latch |
| | 10 | FOUR TIMES Toggle SIGNAL INVERSION |
| | 11 | Even Data {D-IC INPUT Video Signal} |
| | 12 | Odd Data {D-IC INPUT Video Signal} |
| | 13 | Odd Enable |
| | 14 | SSP |
| WHEN THE NUMBER OF DCLK AT DE BLANKING INTERVAL IS ODD NUMBER(n+1) | 15 | FOUR TIMES Toggle SIGNAL INVERSION |
| | 16 | Even Data {D-IC INPUT Video Signal} |
| | 17 | Odd Data {D-IC INPUT Video Signal} |
| | 18 | Data Enable |
| | 19 | SSP |

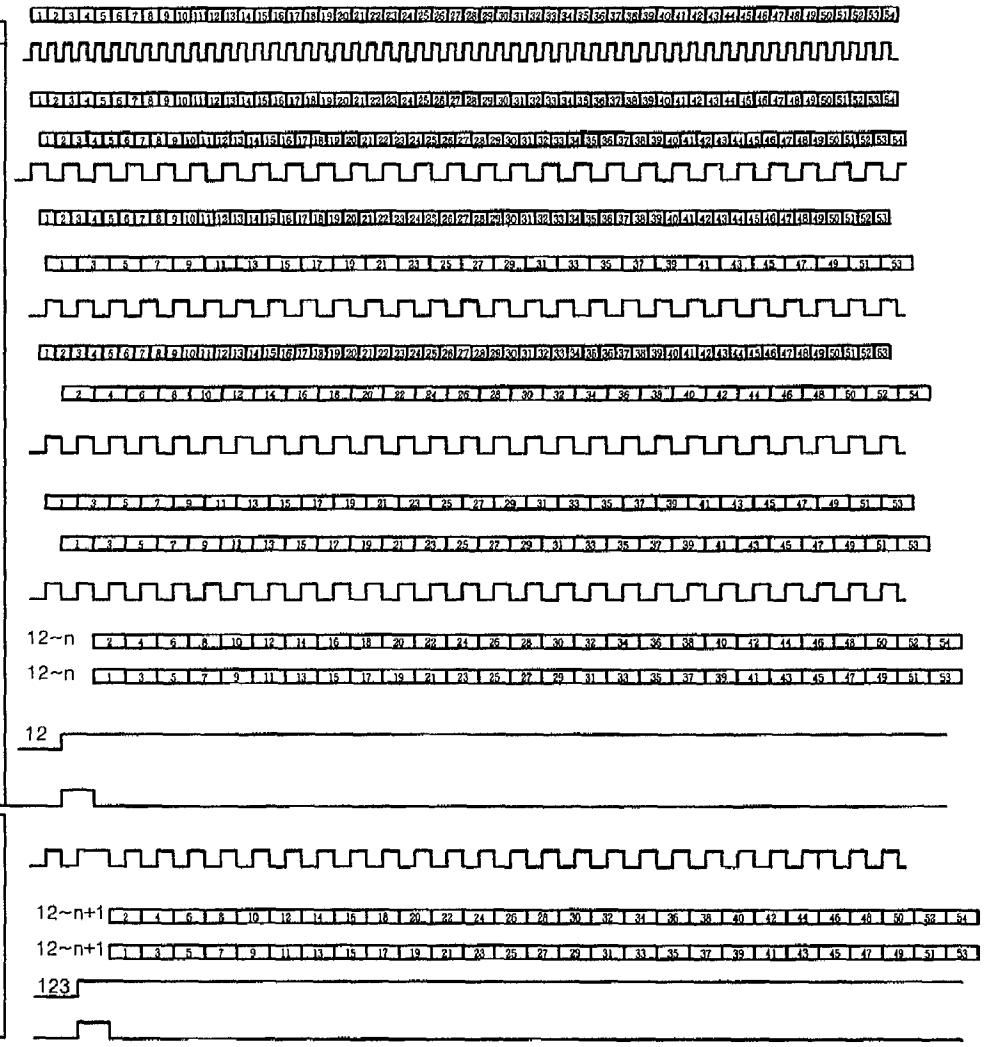

METHOD AND APPARATUS FOR DRIVING LIQUID CRYSTAL DISPLAY

BACKGROUND OF THE INVENTION

1. Field of the Invention

This invention relates to a liquid crystal display, and more particularly to a method and apparatus for driving a liquid crystal display wherein a picture quality can be clearly kept upon conversion of a resolution mode of the liquid crystal display.

2. Description of the Related Art

Generally, a liquid crystal display (LCD) of active matrix driving system uses thin film transistors (TFT's) as switching devices to display a natural moving picture. Since such a LCD can be made into a smaller device in size than the existent Brown tube, it has been widely used for a computer monitor well as office automation equipment such as a copy machine, etc. and portable equipment such as a cellular phone and a pager, etc.

Such a LCD trends toward a high resolution and a large-scale screen. Recently, a liquid crystal monitor of a personal computer has supported resolutions required for high-class equipment such as a workstation. FIG. 1 schematically shows such a LCD.

Referring to FIG. 1, the LCD includes a liquid crystal display panel 2 having TFT's and liquid crystal cells provided between gate lines GL1 to GLm and data lines DL1 to DLn, a source drive integrated circuit (IC) 6 for supplying a data to the data lines DL1 to DLn, a gate drive IC for sequentially applying scanning pulses to the gate lines GL1 to GLm, a timing controller 8 for applying required timing control signals to the source drive IC 6 and the gate drive IC 4, and an interface circuit 12 for supplying a data from a graphic card (not shown) to the timing controller 8.

The source drive IC 6 samples and latches red (R), green (G) and blue (B) data in response to a source shift clock (SSC) from the timing controller to convert a timing system of 'dot at a time scanning' into that of 'line at a time scanning'. The data converted into a system of 'line at a time scanning' is synchronized with the scanning pulses and simultaneously applied to n data lines DL1 to DLn.

Timing control signals applied from the timing controller 8 to the source drive IC 6 include a source start pulse (SSP) for instructing an initiation of a data sampling or latch in one horizontal synchronization interval, a source output enable signal (SOE) for controlling an output of the source drive IC 6 and a polarity control signal (POL) for inverting the polarity of a data upon frame/line/column inversion driving, etc. besides the SSC.

The gate drive IC 6 includes a shift register and a level shifter, etc. The gate driver IC 6 sequentially applies scanning pulses having a gate high voltage in response to a gate start pulse (GSP) from the timing controller 8, to thereby charge a data in the liquid crystal cells.

Timing control signals applied from the timing controller 8 to the gate drive IC 4 include a gate shift clock GSC for determining a time when the gate of the TFT is turned on or off and a gate output enable signal (GOE) for controlling an output of the gate drive IC 4, etc. besides the GSP.

The timing controller 8 receives RGB signals inputted via the interface circuit 12 to distribute it into the source drive IC 6 and control the source drive IC 6 and the gate drive IC 4. The timing controller 8 generates the timing control signals required for the source drive IC 6 and the gate drive IC 4 using the SSC applied from a reference clock generator (not shown).

The interface circuit 12 applies RGB data, a data enable signal I_DE and a dot clock Dclk from the graphic card (not shown) to the timing controller 8.

The timing controller 8 and the interface circuit 12 may include a LVDS circuit so that they can reduce the number of data supply lines and an electromagnetic interference.

The VESA (Video Electronics Standard Association) has defined the number of dot clocks Dclk having a frequency of 65 Mhz at a blanking interval (or a low logic interval) of a data enable signal I_DE inputted from the graphic card to the timing controller 8 in resolution modes of UXGA, SXGA, XGA, SVGA and VGA by an even number. However, if the resolution mode is converted from UXGA, SXGA or XGA into SVGA or VGA, the number of dot clocks Dclk is changed into an odd number. When the resolution mode is converted, a horizontal noise emerges on the screen.

As can be seen from FIG. 2, the conventional timing controller 8 toggles a dot clock Dclk from the interface circuit 12 irrespectively of a resolution conversion of the graphic card to generate the SSC. More specifically, the conventional timing controller 8 operates a reset circuit at a dot clock Dclk generated at the third sequence from a time when the data enable signal I_DE is changed into a high level independently of a resolution to reset a source shift clock SSC. Herein, as shown in FIG. 3, if a resolution mode is UXGA, SXGA or XGA, the number of dot clocks Dclk (65 Mhz in the XGA mode) at a blanking interval of the data enable signal I_DE is an even number (n). In this case, the source shift clock SSC has normal waveform and frequency. On the other hand, as shown in FIG. 4, if a resolution mode is SVGA or VGA, the number of dot clocks Dclk at a blanking interval of the data enable signal DE is changed into an odd number. As a result, when the resolution mode is converted from UXGA, SXGA or XGA into SVGA or VGA, the source start pulse SSP and the source shift clock SSC inputted to the source shift clock SSC go beyond a timing specification stipulating a set-up time and a hold time to cause a horizontal noise on the screen, as shown in FIG. 5.

In FIG. 3 to FIG. 5, the data enable signal DE is created by an internal circuit of the timing controller 8 to instruct a sampling initiation time of an odd data and an even data divided from an input data by means of the timing controller 8. This can be more easily understood from waveform diagrams of FIG. 9A to FIG. 11B capturing a scope screen. In the waveform diagrams of FIGS. 9A to 11B, the horizontal axis represents a time (i.e., 25.0 ns unit), and the vertical axis does a voltage (i.e., 2.0V unit).

As can be seen from FIG. 9A and FIG. 9B that represent waveforms of a source start pulse SSP and a source shift clock SSC at the set-up time and the hold time in a resolution of XGA, since the number of dot clocks Dclk in a resolution of XGA is an even number, waveforms of the source start pulse SSP and the source shift clock SSC take a normal shape. On the other hand, as can be seen from FIG. 10A and FIG. 10B that represent waveforms of the source start pulse SSP and the source shift clock SSC at the set-up time and the hold time when a resolution is converted from XGA into VGA, since the number of dot clocks Dclk is changed from an even number into an odd number, a period of the source shift clock SSC is changed to distort a waveform of the source shift clock SSC at a conversion time of resolution. FIG. 11A and FIG. 11B shows an overlapped state of waveforms of the source start pulse SSP and the source shift clock SSC at a time when an XGA resolution is sustained and at a time when a resolution mode is converted from XGA into VGA, respectively.

SUMMARY OF THE INVENTION

Accordingly, it is an object of the present invention to provide a method and apparatus for driving a liquid crystal display wherein a picture quality can be clearly kept upon conversion of a resolution mode of the liquid crystal display.

In order to achieve these and other objects of the invention, a method of driving a liquid crystal display according to one aspect of the present invention includes the steps of receiving a data enable signal for indicating a time interval when a video data exists; detecting an enable initiation time of the data enable signal; generating a reset signal at said enable initiation time of the data enable signal; and resetting a source shift clock for sampling the video data in response to the reset signal.

The method further includes the steps of sampling and then latching the video data in response to the source shift clock; applying the latched video data to data lines of a liquid crystal display panel; and sequentially applying scanning pulses to gate lines of the liquid crystal display panel.

A driving apparatus for a liquid crystal display according to another aspect of the present invention includes a source shift clock reset unit for detecting an enable initiation time of a data enable signal for indicating a time interval when a vide data exists to generate a reset signal; and a reference clock generator for generating a source shift clock for sampling the video data at said enable initiation time, wherein the source shift clock is reset at said enable initiation time in response to the reset signal.

The driving apparatus further includes a liquid crystal display panel having liquid crystal cells provided at pixel areas between the data lines and the gate lines perpendicularly crossing each other and thin film transistors provided at intersections between the data lines and the gate lines to drive the liquid crystal cells; a source driver for sampling and then latching the video data in response to the source shift clock and for applying the latched data to the data lines of the liquid crystal display panel; and a gate driver for sequentially applying scanning pulses to the gate lines of the liquid crystal display panel to select scanning lines; and a timing controller for controlling the source driver and the gate driver.

In the driving apparatus, the source shift clock reset unit and the reference clock generator are included in the timing controller.

The source shift clock reset unit includes a D flip-flop for receiving the data enable signal and a dot clock via an input line to delay the data enable signal in accordance with the dot clock; an inverter for inverting the delayed data enable signal; and an AND gate for making a logical product operation of the delayed and inverted enable signal and the data enable signal from the input line to generate a high logic signal for indicating an enable initiation time of the data enable signal; and a reset part for generating a reset signal for resetting the source shift clock in response to the high logic signal generated in the AND gate.

BRIEF DESCRIPTION OF THE DRAWINGS

These and other objects of the invention will be apparent from the following detailed description of the embodiments of the present invention with reference to the accompanying drawings, in which:

FIG. 2 is an output waveform diagram of the timing controller shown in FIG. 1;

DETAILED DESCRIPTION OF THE PREFERRED EMBODIMENT

Figure 1:
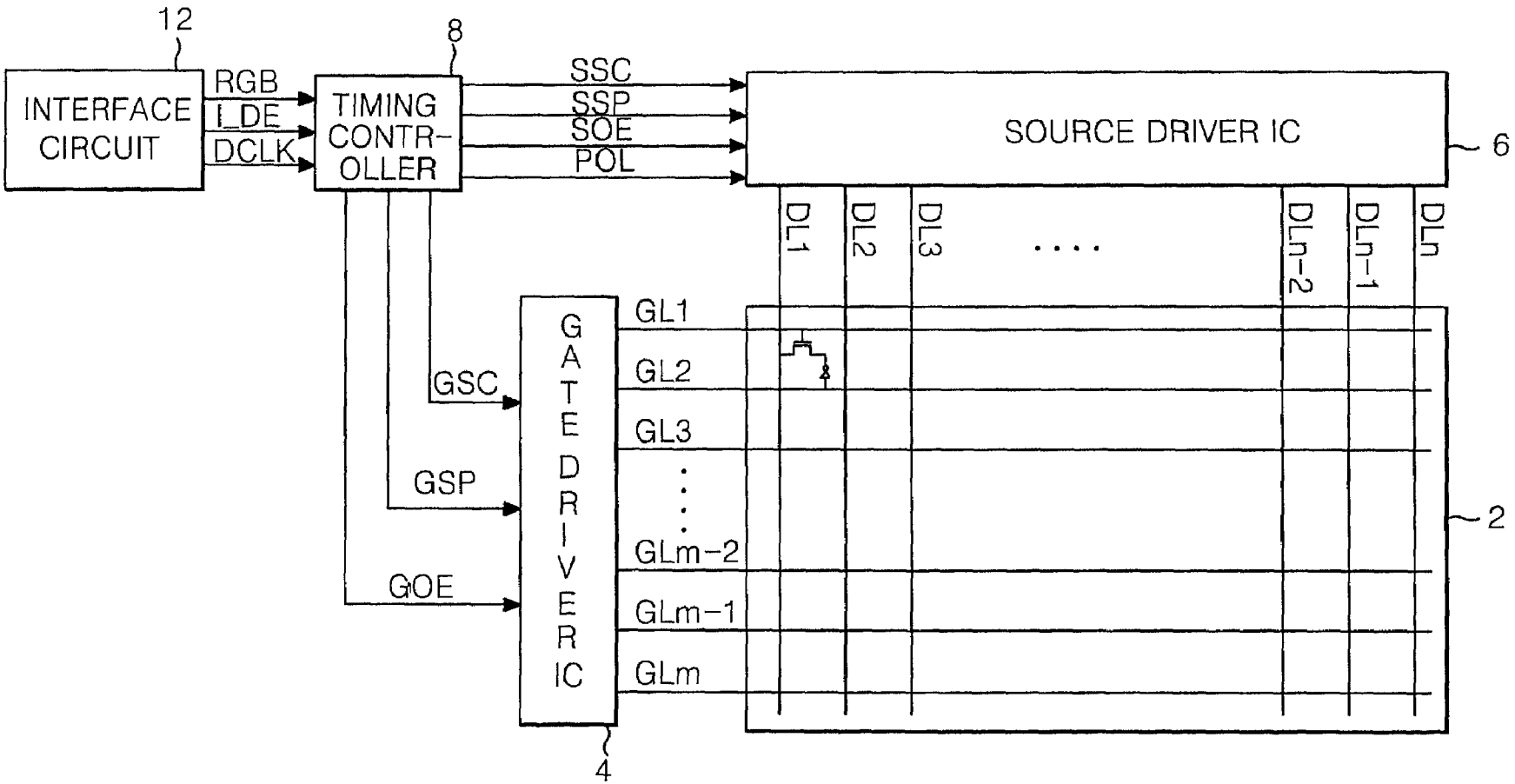
FIG. 1 CONVENTIONAL ART
FIG. 1 is a schematic block diagram showing a configuration of a driving apparatus for a conventional liquid crystal display.
Figure 3:
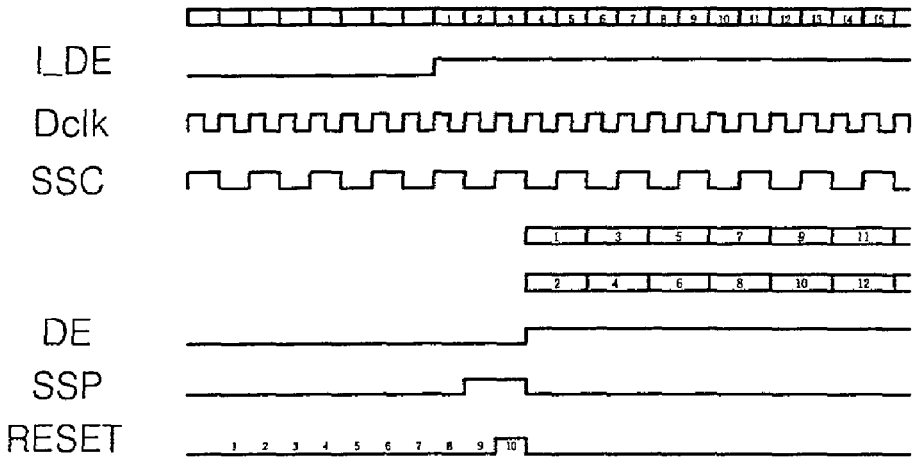
FIG. 3 CONVENTIONAL ART
FIG. 3 is an input/output waveform diagram of the timing controller shown in FIG. 1 in the resolution modes of UXGA, SXGA and XGA.
Figure 4:
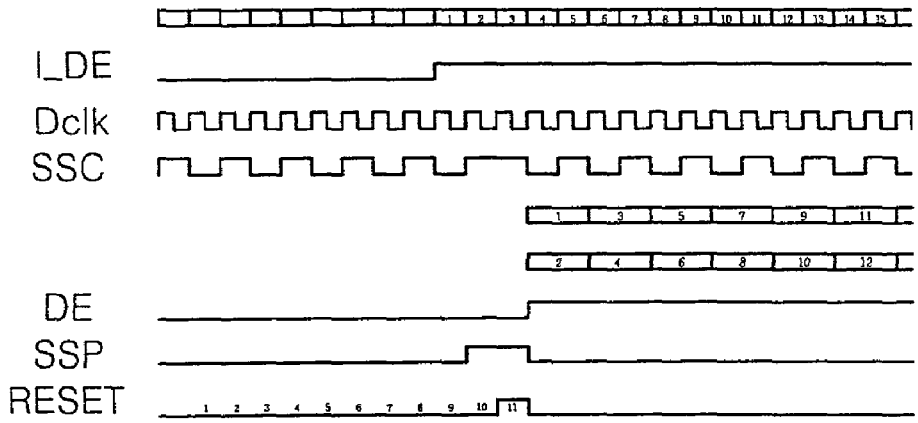
FIG. 4 CONVENTIONAL ART
FIG. 4 is an input/output waveform diagram of the timing controller shown in FIG. 1 in the resolution modes of VGA and SVGA.
Figure 5:
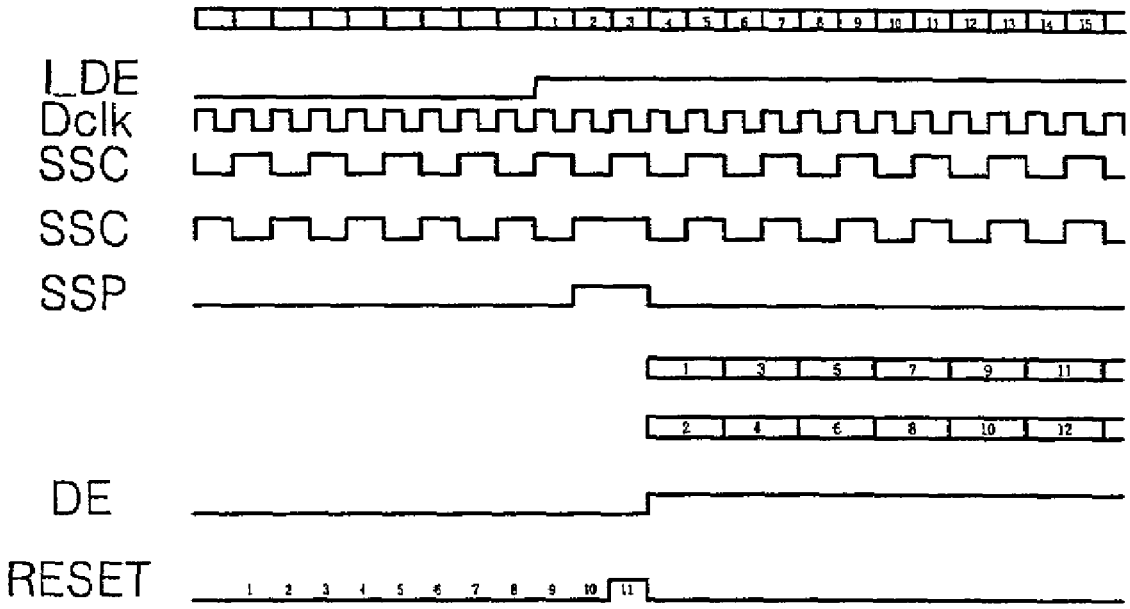
FIG. 5 is an input/output waveform diagram of the timing controller shown in FIG. 1 in the resolution modes of XGA and VGA.
Figure 6:
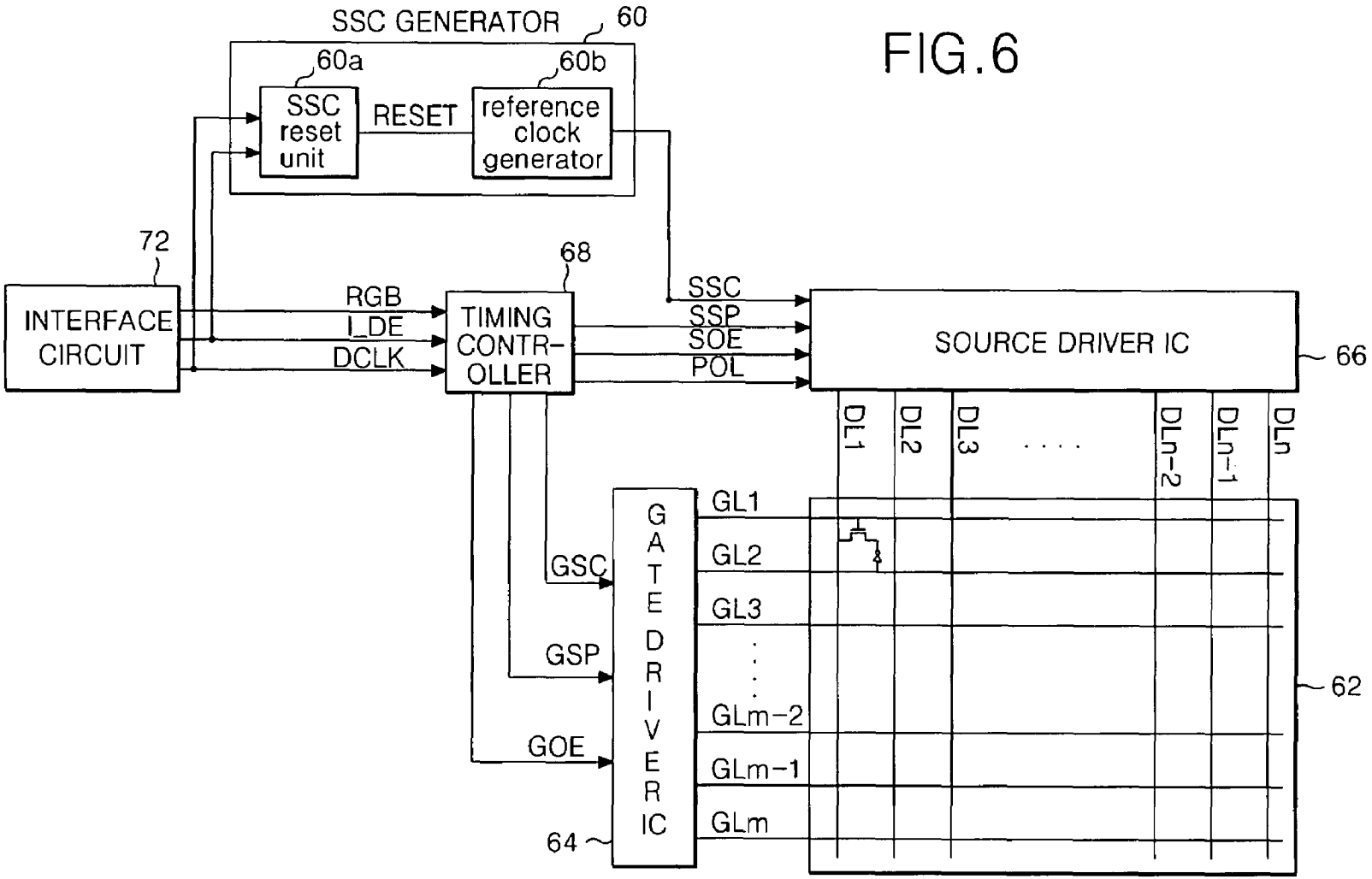
FIG. 6 is a schematic block diagram showing a configuration of a driving apparatus for a liquid crystal display according to an embodiment of the present invention.

Referring to FIG. 6, there is shown a driving apparatus for a liquid crystal display (LCD) according to an embodiment of the present invention.

The LCD includes a liquid crystal display panel 62 having TFT's and liquid crystal cells provided between gate lines GL1 to GLm and data lines DL1 to DLn, a source drive integrated circuit (IC) 66 for supplying a data to the data lines DL1 to DLn, a gate drive IC 64 for sequentially applying scanning pulses to the gate lines GL1 to GLm, a timing controller 68 for applying required timing control signals to the source drive IC 66 and the gate drive IC 64, a source shift clock (SSC) generator 60 for receiving a dot clock Dclk and a data enable signal I_DE to generate a source shift clock SSC, and an interface circuit 72 for supplying a data from a graphic card (not shown) to the timing controller 72.

The source drive IC 66 samples and latches red (R), green (G) and blue (B) data in response to a source shift clock SSC from the SSC generator 60 and thereafter applies a data to n data lines DL1 to DLn simultaneously in synchronization with scanning pulses.

The gate drive IC 64 includes a shift register and a level shifter, etc. The gate driver IC 64 sequentially applies scanning pulses having a gate high voltage in response to a gate start pulse (GSP) from the timing controller 68.

The timing controller 68 receives RGB signals inputted via the interface circuit 72 to distribute them into the source drive IC 66 and generates timing control signals to control the source drive IC 66 and the gate drive IC 64.

The interface circuit 72 applies RGB data, a data enable signal I_DE and a dot clock Dclk from the graphic card (not shown) to the timing controller 68.

The SSC generator 60 includes a source shift clock (SSC) reset unit 60*a* and a reference clock generator 60*b*. The SSC reset unit 60*a* receives a dot clock Dclk and a data enable signal I_DE. The SSC reset unit 60*a* senses a time when a data enable signal I_DE is changed into a high level irrespectively of the number of dot clocks Dclk upon conversion of a resolution mode to generate a reset signal (RESET) at the time when a data enable signal I_DE is changed into a high level and supplies the reset signal (RESET) to the reference clock generator 30. The reference clock generator 30 generates a source shift clock and resets the source shift clock (SSC) at the time when a data enable signal I_DE is changed from a low logic into a high logic in response to the reset signal (RESET). The reference clock generator 30 applies the source shift clock SSC to the source drive IC 6. The SSC generator 60 may be included in the timing controller 68.

Figure 7:
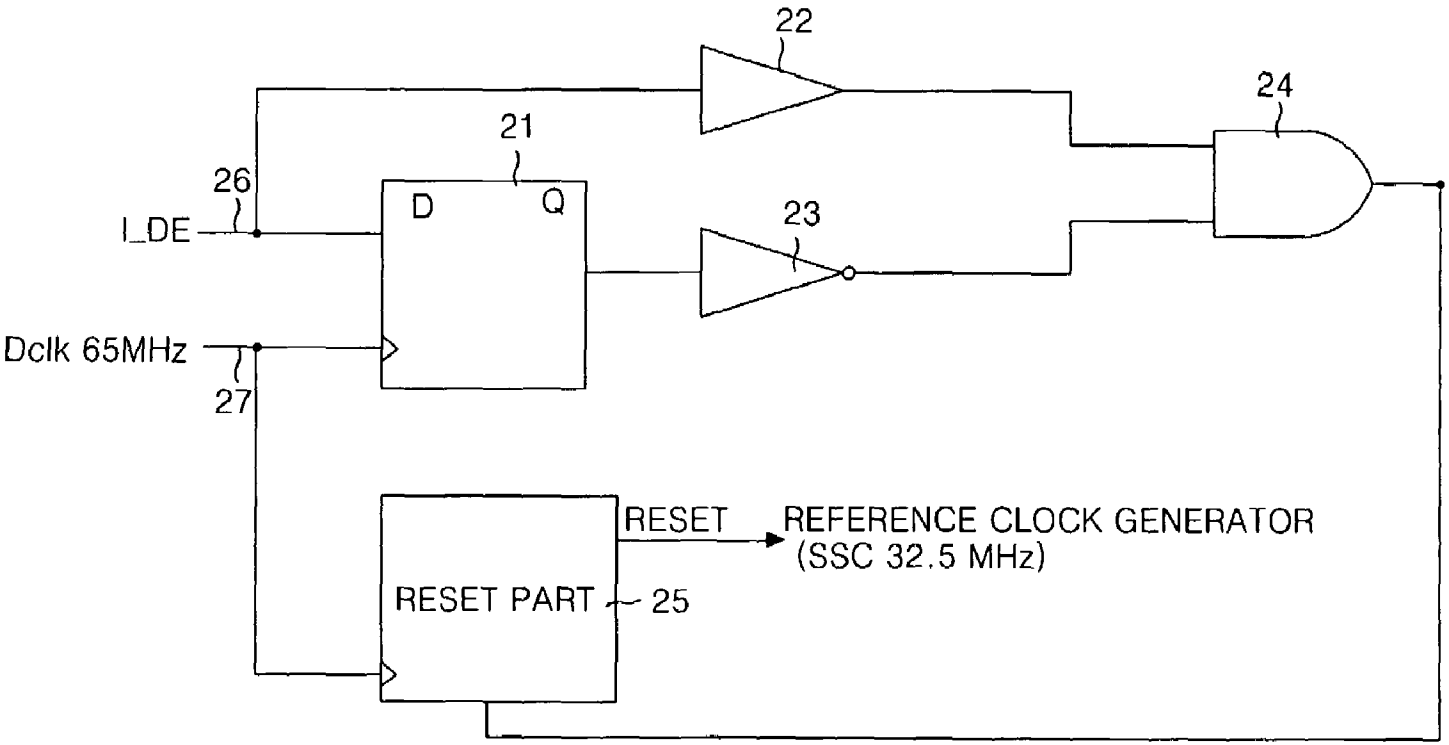
FIG. 7 is a detailed circuit diagram of the source shift clock reset unit shown in FIG. 6.

As shown in FIG. 7, the SSC reset unit 60*a* includes a D flip-flop 21 receiving the data enable signal I_DE and the dot clock Dclk from the interface circuit 72, an inverter 23 connected to an output terminal of the D flip-flop 21, a buffer 22 receiving a data enable signal I_DE via an I_DE input line 26, an AND gate commonly connected to output terminals of the buffer 22 and the inverter 23, and a reset part 25 connected between a Dclk input line 27 and the output terminal of the AND gate 24.

The D flip-flop 21 outputs a data enable signal I_DE whenever the dot clock Dclk is inputted, to thereby delay the data enable signal I_DE by one period of the dot clock Dclk. Herein, a frequency of the dot clock Dclk is assumed to be 65 Mhz.

The buffer 22 applies a data enable signal I_DE inputted via the I_DE input line 26 to a first input terminal of the AND gate 24, and the inverter 23 inverts the data enable signal I_DE delayed by the D flip-flop 21 and applies it to a second input terminal of the AND gate 24.

The AND gate 24 makes a logical product operation of the data enable signal I_DE from the buffer 22 and the delayed and inverted data enable signal I_DE from the inverter to generate a signal indicating a time when the data enable signal I_DE is changed from a low logic into a high logic.

The reset part 25 generates a reset signal (RESET) for resetting the source shift clock SSC in response to a high logic signal inputted from the AND gate 24 and supplies the reset signal (RESET) to the reference clock generator.

Figure 8:
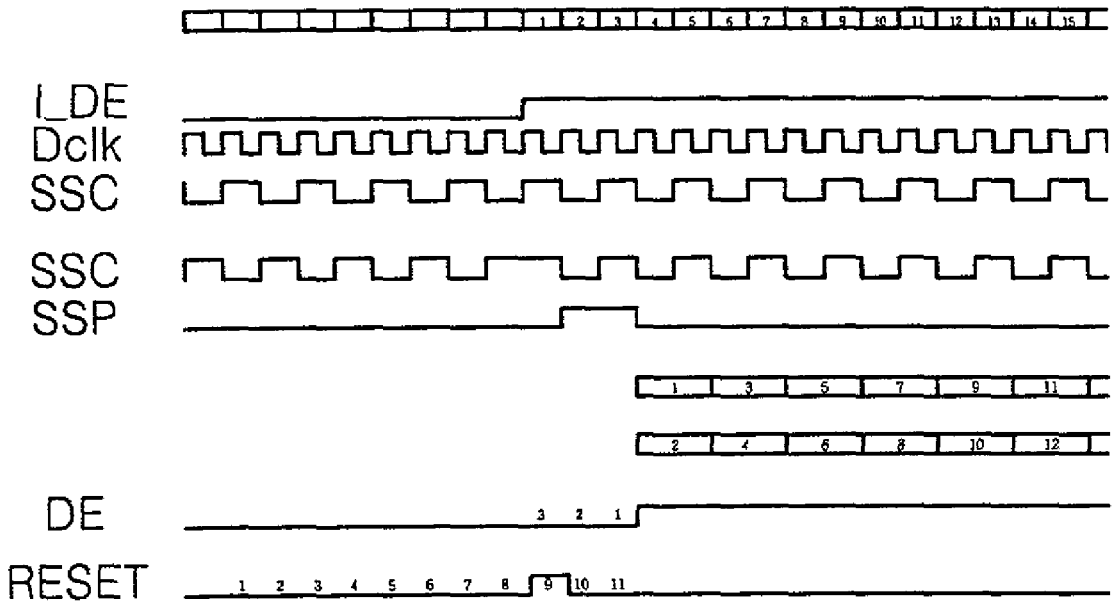
FIG. 8 is an input/output waveform diagram of the driving apparatus for the liquid crystal display according to the embodiment of the present invention.
Figure 9A:
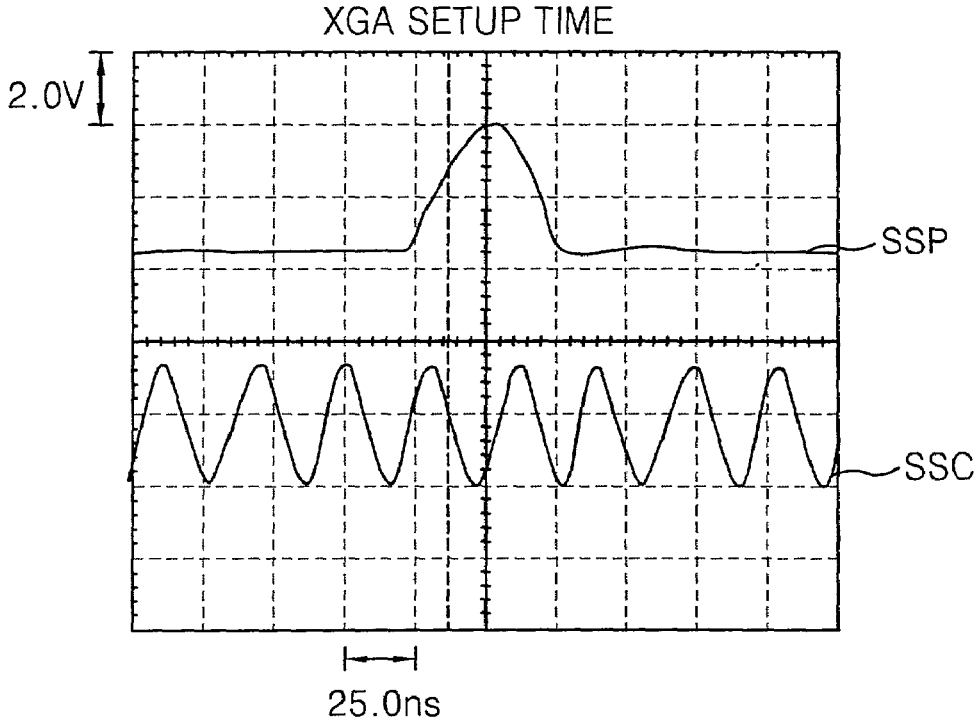
FIG. 9A is a waveform diagram of a source start pulse and a source shift clock appearing at a set-up time in a resolution of XGA.
Figure 9B:
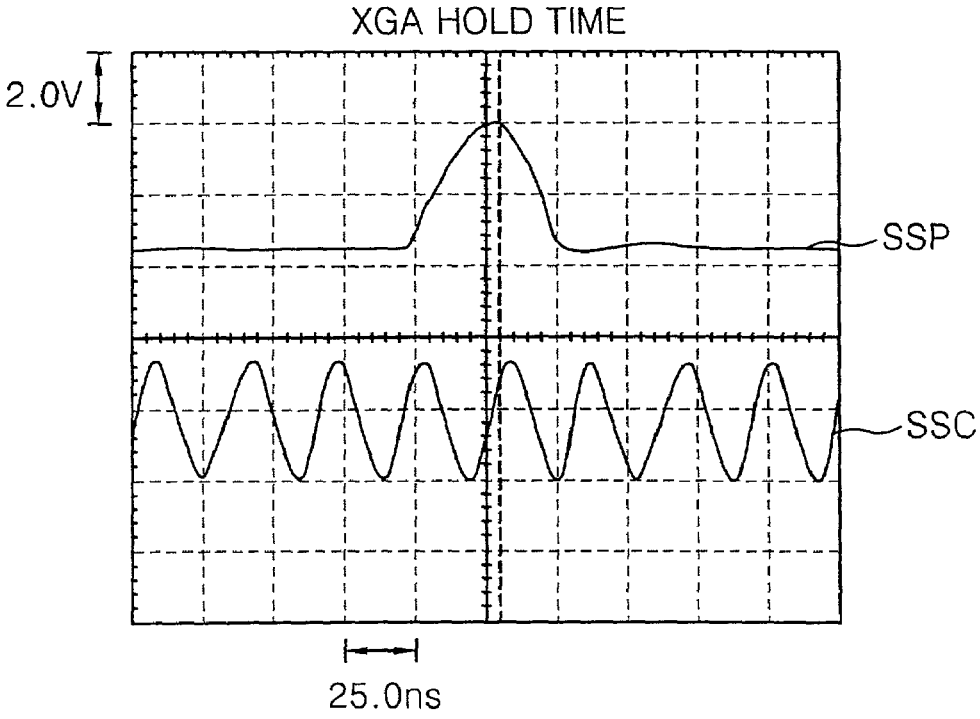
FIG. 9B is a waveform diagram of a source start pulse and a source shift clock appearing at a hold time in a resolution of XGA.
Figure 10A:
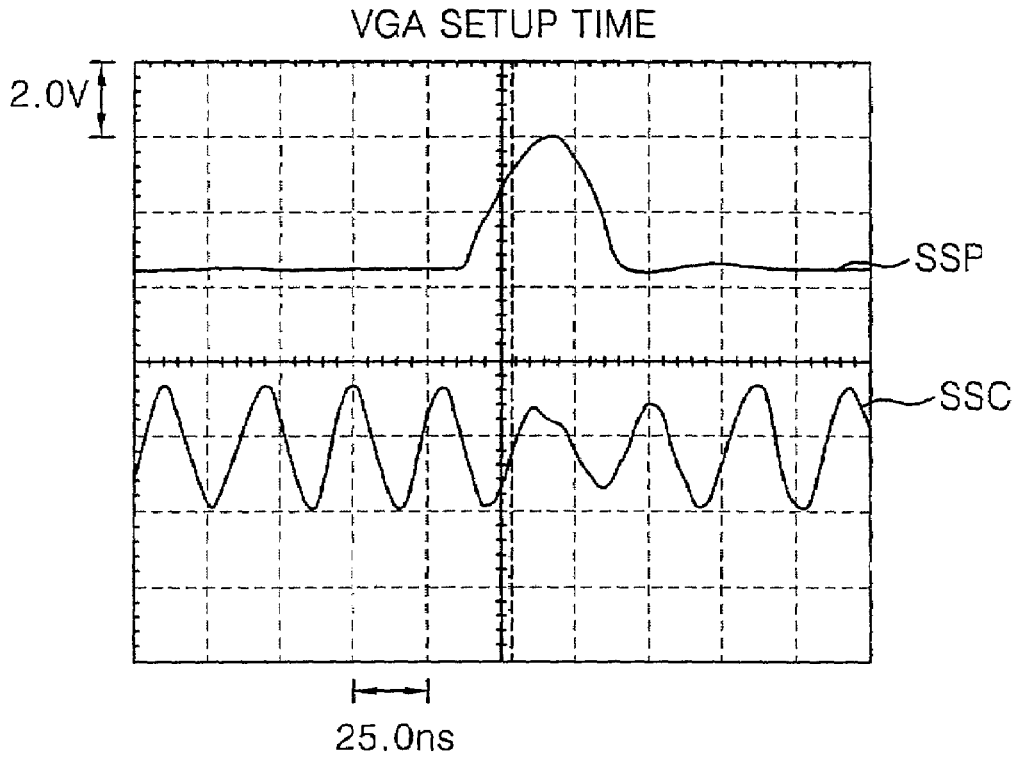
FIG. 10A is a waveform diagram of a source start pulse and a source shift clock appearing at a set-up time in a resolution of VGA.
Figure 10B:
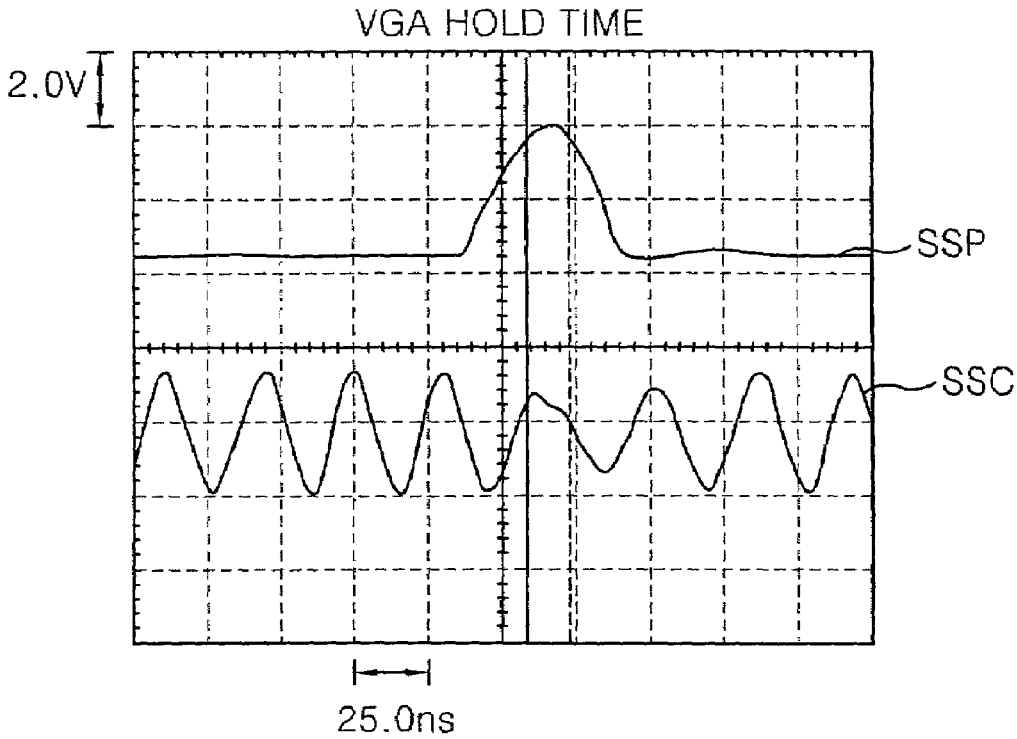
FIG. 10B is a waveform diagram of a source start pulse and a source shift clock appearing at a hold time in a resolution of VGA.
Figure 11A:
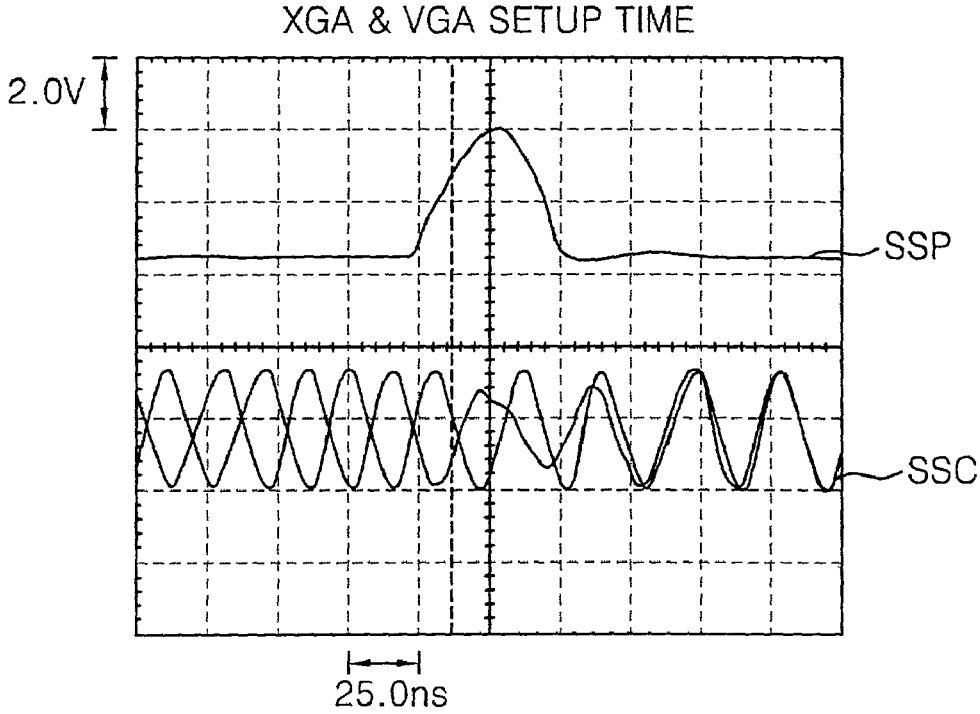
FIG. 11A depicts an overlapped state of the waveforms in FIG. 9A and FIG. 10A.
Figure 11B:
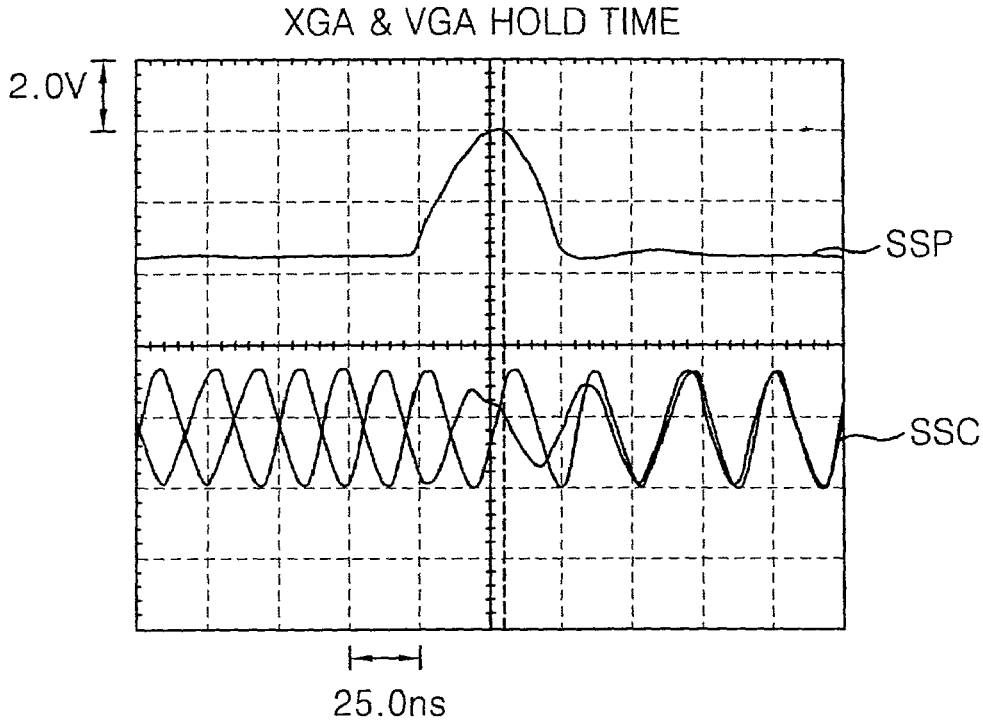
FIG. 11B depicts an overlapped state of the waveforms in FIG. 9B and FIG. 10B.

Referring to FIG. 8, the dot clock Dclk of 65 Mhz is commonly inputted to the D flip-flop 21 and the reset part 25 to synchronize a signal outputted from the AND gate 24 with a signal outputted from the reset part 25. If the data enable signal I_DE is at a blanking interval that is, has a low logic, then an output signal of the AND gate 24 remains at a low logic because an output signal of the buffer 22 maintains a low logic. Since output signals of the buffer 22 and the inverter 23 have a high logic simultaneously at a time when the data enable signal I_DE is changed from a low logic into a high logic, the AND gate 24 generates a high logic of pulse signal. In other words, the AND gate 24 detects a time when a logic value of the data enable signal I_DE is changed from a low logic into a high logic irrespectively of a change in the number of dot clocks upon conversion of a resolution mode, for example, upon conversion from UXGA, SXGA or XGA into SVGA or VGA. The pulse signal generated from the AND gate 24 in this manner is applied to the reset part 25 to reset a source shift clock (SSC) of 32.5 Mhz outputted from the reference clock generator 30. Accordingly, the source shift clock SSC inputted to the source drive IC 66 always has a normal pulse width and frequency in an enable interval of the data enable signal I_DE independently of a conversion of resolution mode.

The source start pulse SSP is generated at twice pulse width the source shift clock SSC between the odd and even data and the reset signal by means of the timing controller 68.

As described above, according to the present invention, an initiation time of an enabling interval of the data enable signal I_DE inputted to the timing controller is detected irrespectively of an odd/even change of the dot clock Dclk caused by a resolution conversion to reset the source shift clock SSC. As a result, the source shift clock SSC and the source start pulse SSP inputted to the source drive IC meets a timing specification in the VESA standard independently of an odd/even change of the dot clock Dclk upon conversion of a resolution mode, for example, upon conversion from UXGA, SXGA or XGA mode into SVGA or VGA mode, so that it becomes possible to prevent a generation of horizontal noise upon conversion of a resolution mode. Furthermore, according to the present invention, timing margins of the source shift clock SSC and the source start pulse SSP inputted to the source drive IC are assured, so that it becomes possible to keep a clear picture under a low temperature or high temperature environment.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a liquid crystal display, comprising the steps of:

receiving a data enable signal from an interface circuit being input to a timing controller for indicating a time interval when a video data exists;

detecting an enable initiation time of the data enable signal;

generating a reset signal at of said enable initiation time of the data enable signal; and resetting a source shift clock in response to the reset signal, the source shift clock being used for sampling and latching the video data by a source driver that applies the video data into data lines formed on a liquid crystal display panel, wherein the source shift clock is reset at said enable initiation time in response to the reset signal irrespective of a change in the number of dot clocks upon conversion of a resolution mode.

2. The method according to claim 1, further comprising the steps of:

sampling and then latching the video data in response to the source shift clock;

applying the latched video data to data lines of the liquid crystal display panel; and sequentially applying scanning pulses to gate lines of the liquid crystal display panel.

3. A driving apparatus for a liquid crystal display, comprising:

a source shift clock reset unit to detect an enable initiation time of a data enable signal from an interface circuit being input to a timing controller for indicating a time interval when a video data exists to generate a reset signal; and a reference clock generator to generate a source shift clock for sampling the video data at said enable initiation time, the source shift clock being used for sampling and latching the video data by a source driver that applies the video data into data lines formed on a liquid crystal display panel, wherein the source shift clock is reset at said enable initiation time in response to the reset signal irrespective of a change in the number of dot clocks upon conversion of a resolution mode.

4. The driving apparatus according to claim 3, further comprising a gate driver for sequentially applying scanning pulses to gate lines of the liquid crystal display panel to select scanning lines, wherein the liquid crystal display panel includes liquid crystal cells provided at pixel areas between the data lines and the gate lines perpendicularly crossing each other and thin film transistors provided at intersections between the data lines and the gate lines to drive the liquid crystal cells, and the timing controller controls the source driver and the gate driver.

5. The driving apparatus according to claim 4, wherein the source shift clock reset unit and the reference clock generator are included in the timing controller.

6. A driving apparatus for a liquid crystal display, comprising:

a source shift clock reset unit to detect an enable initiation time of a data enable signal for indicating a time interval when a vide data exists to generate a reset signal; and a reference clock generator to generate a source shift clock for sampling the video data at said enable initiation time, the source shift clock being reset at said enable initiation time in response to the reset signal, wherein the source shift clock reset unit includes:

a D flip-flop to receive the data enable signal and a dot clock via an input line to delay the data enable signal in accordance with the dot clock;

an inverter to invert the delayed data enable signal;

an AND gate for making a logical product operation of the delayed and inverted enable signal and the data enable signal from the input line to generate a high logic signal for indicating an enable initiation time of the data enable signal; and a reset part to generate a reset signal for resetting the source shift clock in response to the high logic signal generated in the AND gate.

* * * * *